US012779526B2

(12) United States Patent
Reitzig

(10) Patent No.: US 12,779,526 B2
(45) Date of Patent: Nov. 3, 2026

(54) PUNCHING OR RIVETING TOOL

(71) Applicant: WS Wieländer + Schill Professionelle Karosserie-Spezialwerkzeuge GmbH & Co. KG, Tuningen (DE)

(72) Inventor: Klaus Reitzig, Lüdenscheid (DE)

(73) Assignee: WS Weiländer + Schill Professionelle Karosserie-Spezialwerkzeuge GmbH & Co. KG, Tuningen (DE)

( * ) Notice: Subject to any disclaimer, the term of this patent is extended or adjusted under 35 U.S.C. 154(b) by 225 days.

(21) Appl. No.: 18/755,608

(22) Filed: Jun. 26, 2024

(65) Prior Publication Data

US 2025/0001482 A1 Jan. 2, 2025

(30) Foreign Application Priority Data

Jun. 27, 2023 (DE) ..... 20 2023 103 546

(51) Int. Cl.
*B21J 15/10* (2006.01)
*B21J 15/20* (2006.01)

(52) U.S. Cl.
CPC ..... *B21J 15/105* (2013.01); *B21J 15/20* (2013.01)

(58) Field of Classification Search
CPC ..... B21J 15/105; B21J 15/20; B21J 15/10; B21D 28/24; B21D 28/26
See application file for complete search history.

(56) References Cited

U.S. PATENT DOCUMENTS

| | | | | |
|---|---|---|---|---|
| 5,855,054 | A | 1/1999 | Rivera et al. | |
| 10,773,293 | B2 * | 9/2020 | Weyland | B21D 28/243 |
| 2019/0111464 | A1 | 4/2019 | Weyland | |

FOREIGN PATENT DOCUMENTS

| | | | | |
|---|---|---|---|---|
| DE | 29516991 | U1 | 12/1995 | |
| DE | 10021781 | A1 | 11/2001 | |
| DE | 10359879 | A1 | 8/2004 | |
| DE | 102011111533 | A1 | 2/2013 | |
| DE | 102017123723 | A1 | 4/2019 | |
| GB | 253132 | A | 5/1927 | |
| GB | 435390 | A | 9/1935 | |
| WO | WO-2017021363 | A2 * | 2/2017 | B26F 1/34 |

OTHER PUBLICATIONS

Machine Translation of WO2017021363A2 (Year: 2017).*

* cited by examiner

*Primary Examiner* — Debra M Sullivan
(74) *Attorney, Agent, or Firm* — Smartpat PLC

(57) ABSTRACT

A punching or riveting tool, includes a bow with a movable punch and a die. The movable punch and the die are guided in a guide that is decoupled from the bow. The guide may be a guide bracket that is divided into two parts and includes two halves that can be moved relative to one another. The two halves may be coupled to one another via a sliding fit. The die and/or the movable punch may be mounted in a pivotable and/or floating manner relative to a piston or to a counterholder connected to the bow via a clearance fit which comprises a recess and a component engaging in the recess.

11 Claims, 7 Drawing Sheets

PUNCHING OR RIVETING TOOL

CROSS-REFERENCE TO RELATED APPLICATION

This application claims the benefit of German Patent Application DE 20 2023 103 546, filed on Jun. 27, 2023.

TECHNICAL FIELD

The disclosure relates to a punching or riveting tool. More particularly, the disclosure relates to a hydraulic punching or riveting tool. The disclosure also relates to a guide for a die and a punch for such a punching or riveting tool.

BACKGROUND

Punching or riveting tools comprising a bow, have been known.

For example, published patent application DE 10 2011 111 533 A1 discloses a pneumatic/hydraulic pressure generator which can be coupled to a bow for punching or for setting two part rivets.

Such a tool allows to generate high pressing forces, in particular pressing forces of more than 10 t, while having a compact design.

Such tools are used in particular for punching holes in car body panels. In this case, a hydraulic piston drives a punch into a punching die, thus punching out a hole.

When punching high-strength sheet metal, in particular composite materials having multiple layers, the material hardly ever flows during punching. Due to the hardness of the material, the punching slugs are virtually broken out. The compressive stress increases abruptly already at the start of the punching process, which is accompanied by correspondingly high forces acting on the bow.

Due to the elastic properties of the material of the bow (Hooke's law), the bow will deflect during the punching, which means that the punch and the die are no longer precisely aligned axially with each other. This can lead to increased wear or even degradation of the tool, in particular at the edges of the punch and the die. The precision of the punching process also suffers.

SUMMARY

The present application discloses an improved punching or riveting tool that at least mitigates drawbacks of the prior art mentioned above, improves the precision during punching and riveting, and avoids damage to the punching or riveting tool.

This is achieved by a punching or riveting tool and by a guide designed for a punching or riveting tool as disclosed herein.

The punching or riveting tool comprises a bow with a movable punch and a die.

The bow ultimately serves to hold the punch and to provide a counterholder for the die. In particular, the bow holds the die in place by virtue of a counterholder, while the punch which is coupled to the opposite end of the bow moves towards the die.

In particular, a hydraulic cylinder may be arranged on one end of the bow, which comprises a piston by means of which pressure can be exerted on the punch.

The punch and the die are guided in a guide that is decoupled from the bow.

The basic principle of the operation is based on using, for axially guiding the die and the punch, an additional guide onto which no pressing force is exerted during a punching or riveting operation. Thus, only the bow will be deflected during a punching or riveting process, not the guide.

Due to the independent guidance, the coaxial alignment of the punch and the die will not be affected by the pressing force exerted. Despite deflection of the bow, the die and the punch will remain axially aligned with each other.

The guide is preferably nested in the bow.

Preferably, the guide comprises the punch and the die and is mounted on the inner side of the bow via a floating bearing.

The bow in particular comprises a pressure piece through which the punch can be moved, as well as a counterholder. The pressure piece and the counterholder are coupled to the punch and the die, respectively, via a floating bearing.

The floating bearing may in particular comprise a pin that engages in a recess, with play provided between the recess and the pin. This allows the pin to move in the recess in such a way that it can follow a deflection of the bow.

The base of the recess and the end face of the pin may be flat, conical or spherical.

According to one embodiment, the guide is in the form of a second bow, namely a guide bracket which is nested in the bow, i.e. mounted on the inner side of the bow.

Preferably, one arm of the guide bracket comprises a punch guide in which the punch is arranged so as to be displaceable. In order to reset the punch after completion of the punching or riveting operation, the punch guide may comprise a spring, in particular a compression spring.

According to a further refinement, the guide bracket comes in two parts and comprises two halves that can be moved relative to one another. The distance between the arms of the guide bracket can thus be changed. This makes it easy to install the guide bracket inside the bow or to adapt it to different bow sizes.

The two halves are in particular coupled to each other via a sliding fit. For example, the two halves may be coupled to each other via dowel pins that engage in corresponding locating bores.

Preferably, the die and/or the punch is mounted relative to a piston or a counterholder connected to the bow, respectively, in a pivotable and/or floating manner.

For example, a pressure piece that is connected to the piston may engage on the punch or a component coupled to the punch via a clearance fit or a cone. Similarly, the die may also be coupled to the end of the bow via a clearance fit or a cone.

This allows the ends of the bow, including the pressure piece and counterholder, to deflect relative to each other on both the punch side and the die side without thereby changing the axial alignment of the die and the punch.

The punching or riveting tool preferably comes in the form of a hydraulic tool.

In a further refinement, a counterholder on which the die is supported is axially displaceable. More particularly, the die may be axially displaceable by means of an eccentric. This makes it easier to install the guide bracket together with the die guide and die. For mounting the guide bracket, the counterholder can be retracted and then tightened again by turning the eccentric.

The punch and the die, in particular the punch and the die guide can be secured using a pin that is inserted laterally, for example.

The disclosure furthermore relates to a guide, in particular in the form of a guide bracket which is designed for the punching or riveting tool as described above.

The guide may in particular have all the features as described above in conjunction with the guide.

In particular, the guide may comprise a punch guide in which the punch is arranged so as to be axially displaceable.

The punch guide may include a spring that resets the punch.

The guide may also comprise a die guide in which the die is mounted. The punch guide and the die guide are preferably in the form of sleeves which are each inserted into a respective arm of the guide bracket. This improves the precision of axial alignment to each other.

BRIEF DESCRIPTION OF THE DRAWINGS

The subject-matter of the invention will now be explained in more detail with reference to the drawings of FIGS. 1 through 9 by way of an exemplary embodiment.

DETAILED DESCRIPTION

Figure 1:
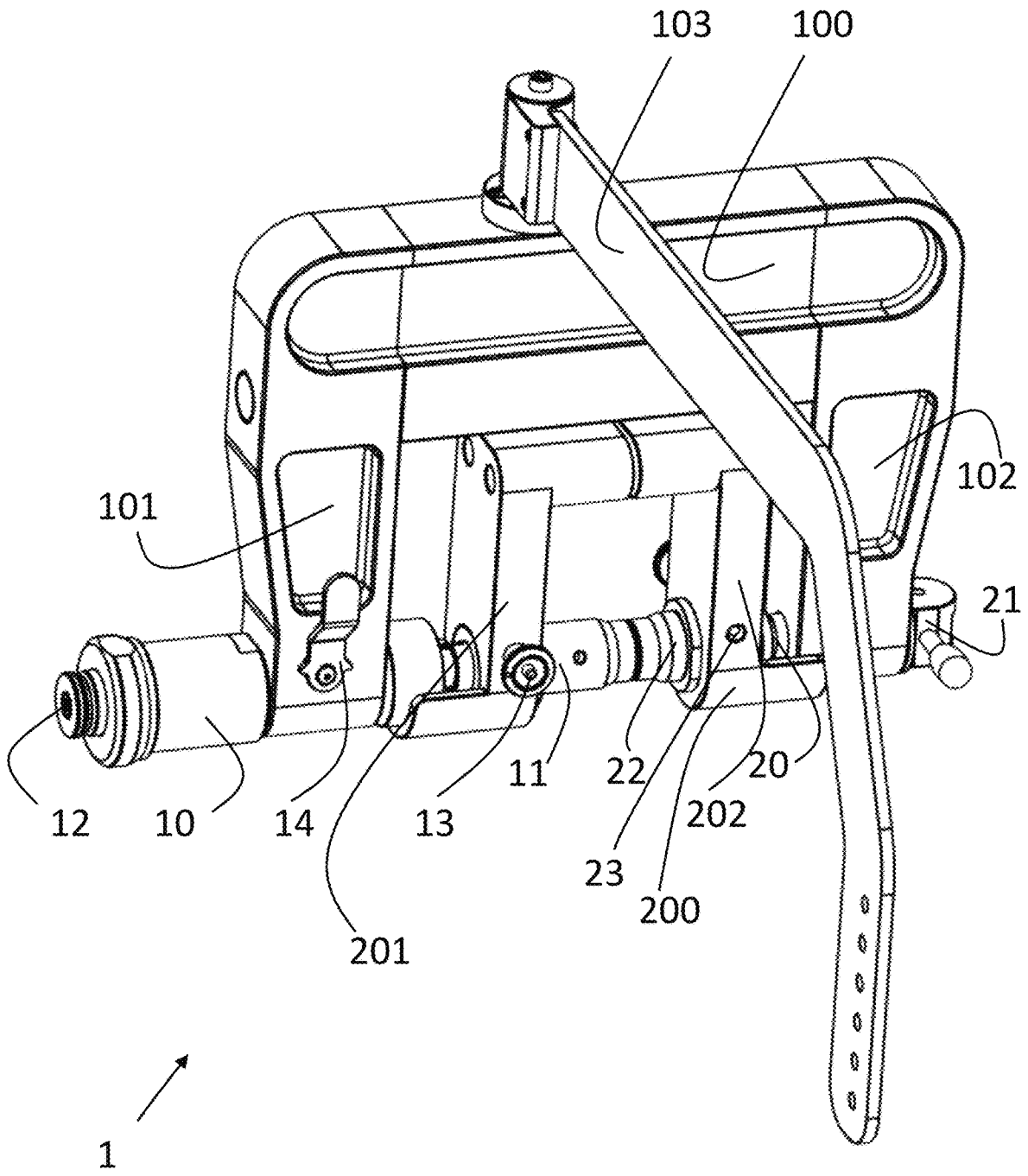
FIG. 1 is a perspective view of a punching tool.

FIG. 1 is a perspective view showing a punching tool 1. The punching tool 1 comprises a bow 100 having an end 101 and an end 102.

The bow 100 may comprise a boom 103 via which the bow 103 can be suspended from a handling device (not shown).

A hydraulic cylinder 10 is inserted into the end 101 and can be fixed using a handle 14.

Hydraulic cylinder 10 comprises the hydraulic connection 12 which may come in the form of a coupling with a self-closing hydraulic valve, for example.

The hydraulic connection 12 is operable to supply the punching tool 1 with pressure. For this purpose, either a portable pressure generator (not shown) can be used, which is connected directly to the hydraulic connection 12. Alternatively, a stationary unit (not shown) can be used as a pressure generator, which is connected to the hydraulic tool 12 via a hose.

The hydraulic cylinder 10 serves to move the punch axially, the punch being accommodated in the punch guide 11.

A counterholder 20 which supports the die guide 22 is arranged on the bow end 102.

A guide bracket 200 is nested in the bow 100, the guide bracket comprising two halves 201, 202 that can be moved relative to one another. The punch guide 11 is secured by a laterally inserted pin 13. Similarly, the die guide 22 is also secured by a laterally inserted pin 23. For installing the guide bracket 200, the counterholder 20 can be retracted using an eccentric 21.

Once installed, the counterholder 20 is tightened again by means of the eccentric 21, and the guide bracket 200 is thus coupled to the bow 100.

During punching, the resulting pressing forces acting between the punch and the die are absorbed by the bow 100. This causes the opposing ends 101, 102 to deflect.

The axial guidance of the punch guide 11 and the die guide 22 is solely accomplished be the guide bracket 200.

A deflection of the arms 101, 102 relative to each other therefore does not lead to any change in the axial position of the punch guide 11 and the die guide 22 and thus of the punch and the die.

Figure 2:
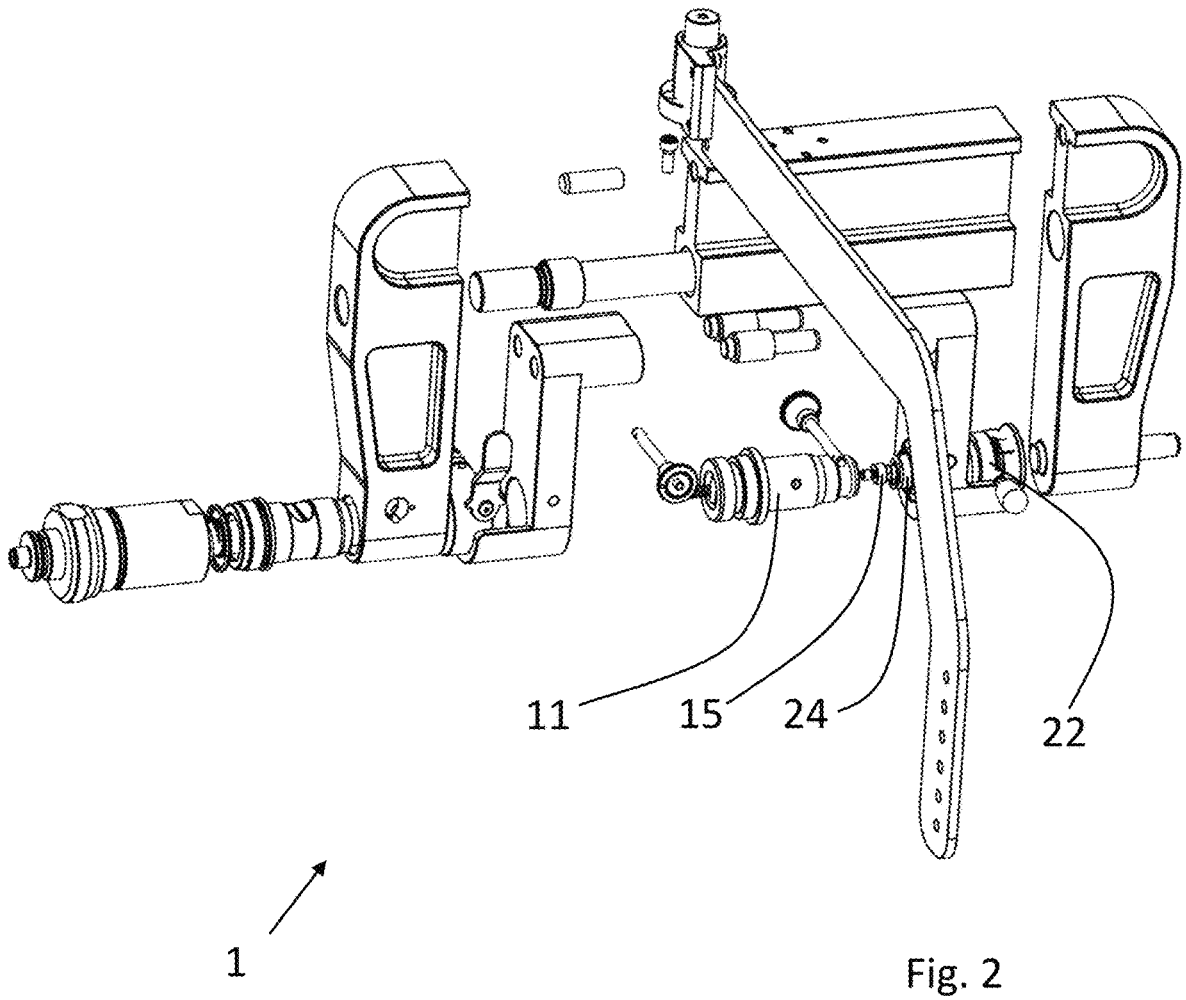
FIG. 2 is an exploded view.

FIG. 2 is an exploded view of the punching tool 1. What can be seen now is the punch 15 which sits in the punch guide 11, as well as the die 24 which sits in the die guide 22.

Figure 3:
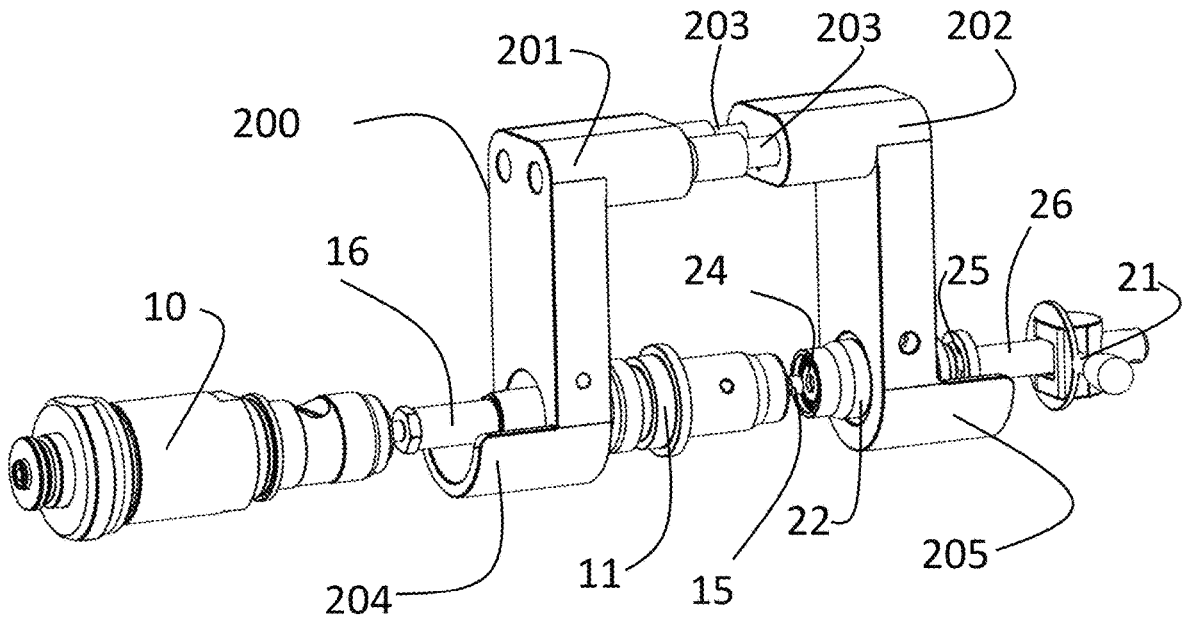
FIG. 3 is a perspective view showing the guide together with the punch, the die and corresponding holders.

In the perspective view of FIG. 3 the bow has been omitted.

Guide bracket 200 comprises the two halves 201 and 202 which can be moved relative to one another. For this purpose, dowel pins 203 are provided at the base of the guide bracket 200, which engage in corresponding locating sleeves of the respective halve 201, 202.

In this way, the distance between the arms of the guide bracket 200 can be changed.

The arms or halves 201, 202 of the guide bracket 200 comprise the two half shells 204 and 205 at their ends, which facilitate assembly.

A hydraulic piston is coupled to a pressure piece 16 via the hydraulic cylinder 10, which pushes forwards the punch 15 guided in the punch guide 11 to carry out a punching operation. During a punching operation, the punch 15 plunges into the die 24 which sits in the die guide 22 which is mounted in the half 202 of the guide bracket 200.

The resulting forces are transmitted to the end of the bow (102 in FIG. 1) via a counterholder 26.

The counterholder 2 can be tightened against the bias of a spring 25 when the guide bracket 200 is installed.

Figure 4:
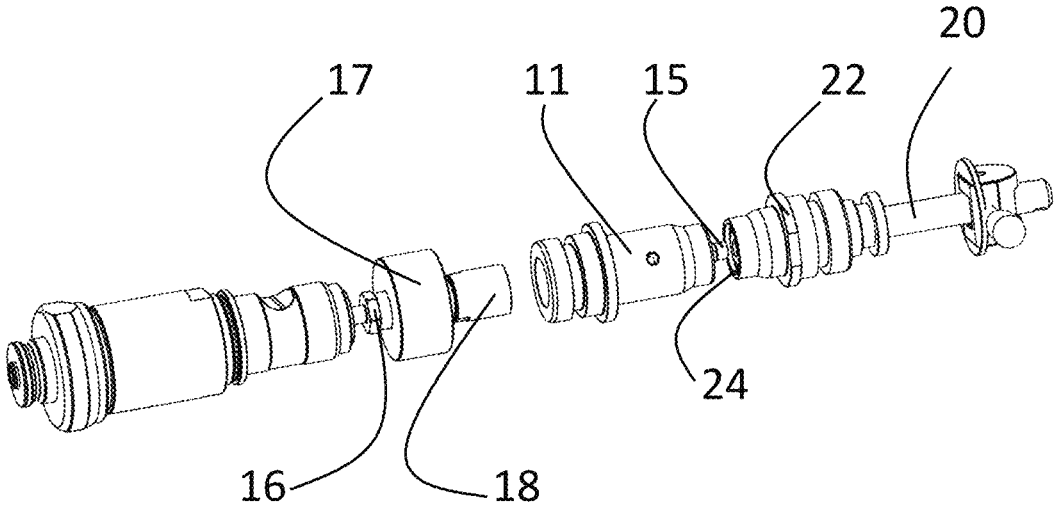
FIG. 4 is an exploded perspective view of the punch, the die together with guides.

In the perspective view of FIG. 4 the guide bracket has now also been omitted. An intermediate piece 18 is pushed forward by pressure piece 16, which drives the punch 15 mounted in punch guide 11.

In the present exemplary embodiment, the pressure piece 16 is guided axially via a plastic ring 17 made of an elastic material. A clearance fit is provided between pressure piece 16 and intermediate piece 18, which is designed in such a way that a change in the axial position of the pressure piece 16 does not affect the axial alignment of the intermediate piece 18 and thus of the punch 15. Pressure piece 16 and intermediate piece 18 are therefore coupled via a floating bearing.

The counterholder 20 is also mounted in a floating manner with respect to the die 24 mounted in die guide 22.

Figure 5:
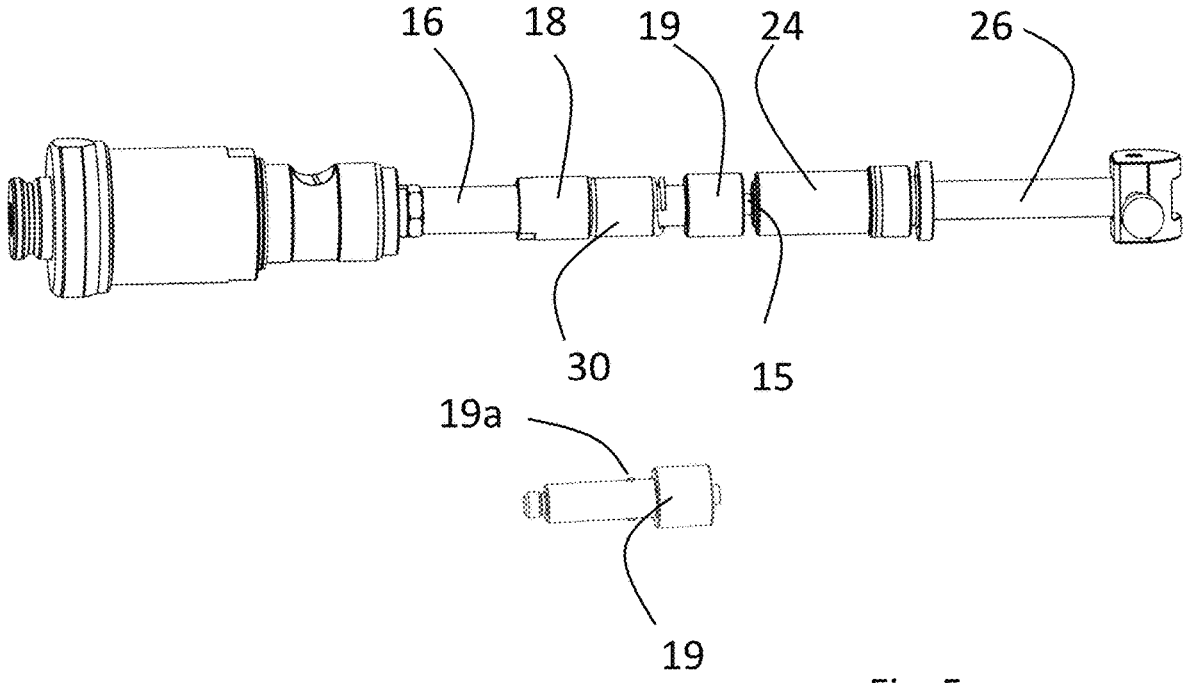
FIG. 5 is a perspective view of the punch, the die and guides.

In the perspective view of FIG. 5, the punch guide and the die guide have been also omitted now.

As already stated above, the pressure piece 16 is mounted in a floating manner relative to the intermediate piece 18.

The punch 15 sits in a punch holder 19.

Once a punching operation has been carried out, the punch holder 19 together with the punch 15 is reset by a spring 30. Spring 30 is accommodated in the housing of the punch guide.

The punch holder 19 is in the form of a sleeve that can be moved against the pressure force of the spring 30 inside the housing of the punch guide. It may be secured by a dowel pin 19*a*.

The punch holder 19 may come in the form of a threaded sleeve into which the punch 15 is screwed.

On the opposite side, there is the die 24 which is floatingly mounted in counterholder 26.

Details of the floating mount of the punch and the die shall now be explained in more detail with reference to FIGS. 6 through 9.

Figure 6:
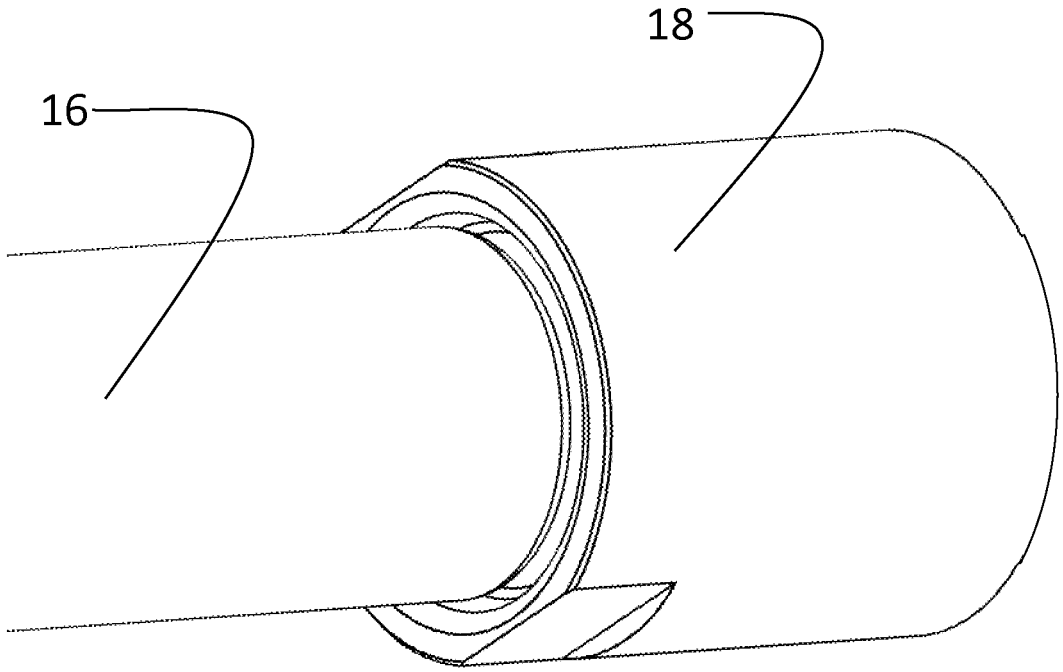
FIG. 6 is a detailed view of the pressure piece and an intermediate piece which is coupled to the die.

FIG. 6 is a detailed view of the pressure piece 16 and the intermediate piece 18.

Pressure piece 16 engages in a recess 18*a* of the intermediate piece 18.

This engagement is a clearance fit.

Figure 7:
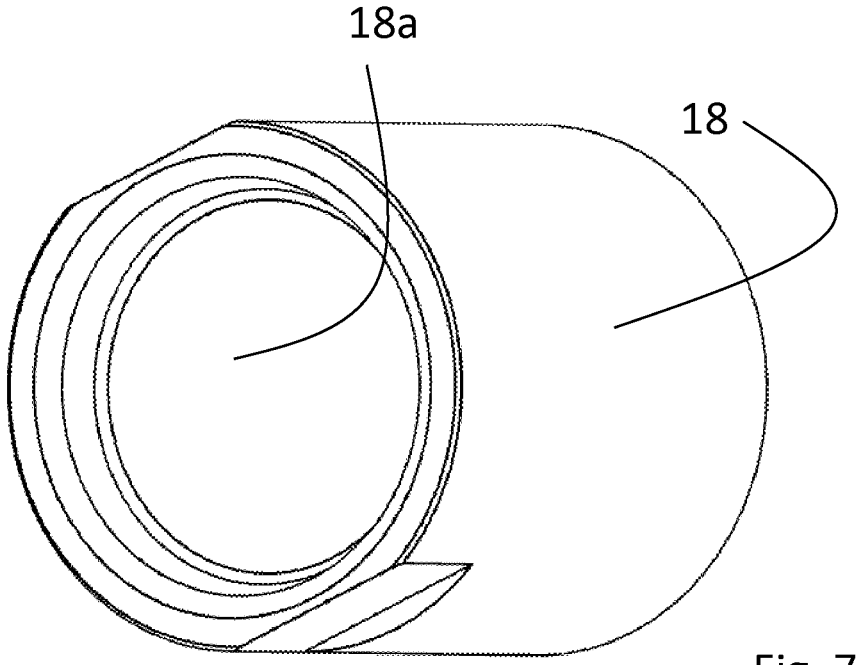
FIG. 7 is a perspective view of the intermediate piece.

As shown in FIG. 7, the recess may have conical walls. A spherical design is also conceivable (not shown).

In this exemplary embodiment, the base of the recess 18*a* is flat.

Figure 8:
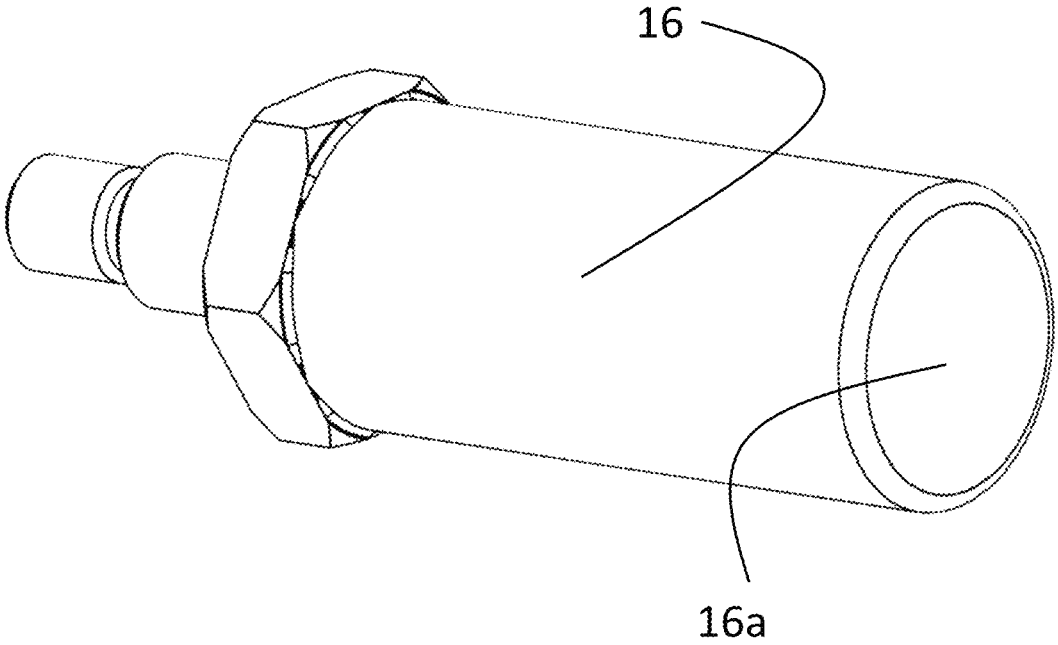
FIG. 8 is a perspective view of the pressure piece.

The pressure piece 16 shown in FIG. 8 may have a conical or spherical shape, for example. In this way, tilting or an offset of the central axes of the pressure piece 16 and the intermediate piece 18 can be compensated for.

In this exemplary embodiment, the end face 16*a* of the pressure piece 16 is flat. The side walls can be conical.

The axial position of the intermediate piece 18 is determined solely by the guide bracket.

Figure 9:
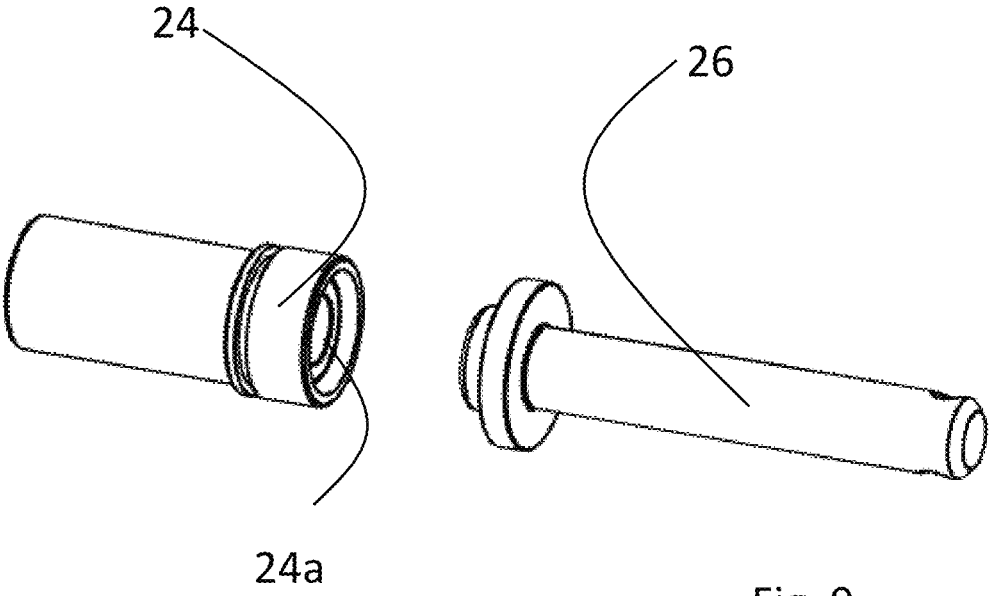
FIG. 9 is a perspective view showing the counterholder and the die.

A similar decoupling is also provided on the side of the die 24, as shown in FIG. 9. The counterholder 26 engages in a recess 24*a* on the rear side of the die 24 in a floating manner.

The head of the counterholder 26 and the recess on the rear side of the die 24 may, as shown here, also comprise a conical wall or be spherical in shape.

The invention made it possible to ensure precise guidance of the punch and the die in a simple way, even when punching in high-strength materials.

What is claimed is:

1. A punching or riveting tool, comprising:

a bow having a first end and a second end, the bow being configured to absorb pressing forces during a punching or riveting operation;

a punch arranged at the first end of the bow and movable toward a die arranged at the second end of the bow;

a guide supported within the bow and guiding both the punch and the die along a common axis, wherein the punch and the die are coupled to the bow by respective floating couplings that permit relative displacement between the bow and each of the punch and the die caused by deflection of the first and second ends of the bow, and wherein the guide maintains the punch and the die in axial alignment with one another along the common axis during the punching or riveting operation.

2. The punching or riveting tool as in claim 1, wherein the guide is a guide bracket having a first arm and a second arm, and wherein a punch guide and a die guide are inserted into respective openings of the first arm and the second arm, the respective openings being axially aligned with one another.

3. The punching or riveting tool as in claim 2, wherein the guide bracket comprises a first bracket half including the first arm and a second bracket half including the second arm, and wherein the first bracket half and the second bracket half are linearly movable relative to one another to vary a distance between the first arm and the second arm.

4. The punching or riveting tool as in claim 3, wherein the first bracket half and the second bracket half are coupled to one another via a sliding fit comprising a dowel pin received in a corresponding locating bore, the sliding fit constraining relative movement of the first bracket half and the second bracket half to linear movement.

5. The punching or riveting tool as in claim 2, wherein the punch is arranged in the punch guide in an axially displaceable manner.

6. The punching or riveting tool as in claim 5, wherein the punch guide comprises a housing, a punch holder arranged in the housing and carrying the punch, and a spring arranged in the housing and biasing the punch holder away from the die.

7. The punching or riveting tool as in claim 1, wherein the respective floating couplings comprise:

a punch-side floating coupling in which a pressure piece operatively connected to a piston engages, with play, a recess formed in an intermediate piece coupled to the punch; and a die-side floating coupling in which a counterholder connected to the bow engages, with play, a recess formed in the die.

8. The punching or riveting tool as in claim 1, wherein the punching or riveting tool is a hydraulic tool.

9. The punching or riveting tool as in claim 1, wherein the die is axially displaceable.

10. The punching or riveting tool as in claim 9, further comprising a counterholder arranged at the second end of the bow and supporting the die, wherein the counterholder is axially displaceable relative to the bow by an eccentric to axially displace the die.

11. The punching or riveting tool as in claim 1, wherein the guide can be coupled to a punch guide and/or die guide by a laterally insertable pin.

* * * * *